US005160839A

United States Patent [19]

Nishiyama et al.

[11] Patent Number: 5,160,839

[45] Date of Patent: Nov. 3, 1992

[54] APPARATUS AND METHOD FOR DETERMINING INSTANTANEOUS SPATIAL POSITION OF SPHERICAL FLYING OBJECT

[75] Inventors: Tetsuji Nishiyama, Akashi; Takashi Teraguchi, Kobe, both of Japan

[73] Assignee: Sumitomo Rubber Industries, Ltd., Kobe, Japan

[21] Appl. No.: 703,751

[22] Filed: May 21, 1991

[30] Foreign Application Priority Data

Jun. 4, 1990 [JP] Japan ..... 2-147095

[51] Int. Cl.[5] ..... G01V 9/04

[52] U.S. Cl. ..... 250/222.1; 356/375

[58] Field of Search ..... 250/561, 221, 222.1; 356/375

[56] References Cited

U.S. PATENT DOCUMENTS 4,105,925 8/1978 Rossol et al. ..... 250/561

5,008,529 4/1991 Nakamura ..... 250/221

FOREIGN PATENT DOCUMENTS 52-8876 1/1977 Japan ..... 250/222.1

2104649 3/1983 United Kingdom ..... 250/561

*Primary Examiner*—David C. Nelms

*Assistant Examiner*—K. Shami

*Attorney, Agent, or Firm*—William H. Eilberg

[57] ABSTRACT

The present invention utilizes, in combination, an irradiator, a screen and an optical sensor. The irradiator generates a parallel light band to form a linear image region on the screen. A spherical flying object is made to pass transversely through the parallel light band to form a silhouette within the image region. The silhouette is detected by the optical sensor to determine the instantaneous spatial position of the flying object. The position thus determined may be utilized for example to calculate the initial trajectory angle of a golf ball hit from a fixed position.

18 Claims, 4 Drawing Sheets

APPARATUS AND METHOD FOR DETERMINING INSTANTANEOUS SPATIAL POSITION OF SPHERICAL FLYING OBJECT

BACKGROUND OF THE INVENTION

1. Field of the Invention

This invention relates generally to position determination of a flying object. More particularly, the present invention relates to a method and apparatus for optically determining an instantaneous spatial position of a spherical flying object such as golf ball or tennis ball.

2. Description of the Prior Art

Quite often, golfers perform exercise using a golf exercising machine or playing in a golf exercising facility whose space is limited. In such a case, it is difficult for the golfer to know how the hit ball is actually carried due to the limited space of the machine or facility. It then becomes necessary to determine an instantaneous spatial position of the hit ball and to process the thus determined ball position for calculating the vertical trajectory angle or horizontal trajectory angle (lateral deviation angle) of the hit ball, thereby providing an approximate ball flying path. Further, even if there is an ample space for hitting a ball over a full flying distance, it is sometimes preferable for stroke checking to know the trajectory angle of the hit ball.

Conventionally, there are various methods for determining an instantaneous spatial position of a hit ball.

A first conventional method utilizes a multiplicity of cords arranged to cover a flying path region for a hit ball and respectively connected to electric switches. In this method, a hit ball is caused to impinge particular one of the cords, thereby actuating a corresponding switch.

However, the first method is defective in that the ball flying path is unacceptably obstructed by the cords. Further, the cords may be damaged by repetitive contact with the ball. Moreover, the ball may come into improper impingement with a cord, consequently failing to provide intended detection.

A second conventional method utilizes a multiplicity of photoelectric switches arranged to cover a flying path region for a hit ball. In this method, a particular one of the photoelectric switches is actuated when light input for that particular switch is cut off by passage of the hit ball.

However, the second method is disadvantageous in that a great number of photoelectric switches are necessary to increase the resolution of detection and/or to optically cover a wide flying path region.

In a third conventional method, use is made of an oscillating mirror or rotary polygon mirror combined with a lens system for generating scanning laser beams which are made to repetitively translate in a scanning plane. A hit ball is made to pass through the scanning plane, and beam cut-off timing is measured to determine an instantaneous spatial position of the hit ball.

The third method relies on mechanical movement of the oscillating mirror or rotary polygon mirror, and such mechanical movement inevitably provides irregularities for scanning translational movement of the laser beams. Further, the mechanical movement of the mirror may be also affected by the environmental conditions such as temperature, humidity and so on. Thus, the third method cannot necessarily provide accurate position determination.

A fourth conventional method utilizes a video camera for directly taking an image of a flying ball. In this method, an instantaneous position of the ball is directly determined by image measurement.

However, the fourth method is defective in that two different ball positions on the same sight line of the video camera provides the same image position, consequently resulting in erroneous position detection. Further, a relatively small number of picture elements are assigned for a ball image, so that there is also a problem in image resolution.

SUMMARY OF THE INVENTION

It is, therefore, an object of the present invention to provide an apparatus for reliably determining an instantaneous spatial position of a spherical flying object, particularly a golf ball or a tennis ball, while resolving the problems of the prior art described above.

Another object of the present invention to provide a method for reliably determining an instantaneous spatial position of a spherical flying object, particularly a golf ball or a tennis ball, while resolving the problems of the prior art described above.

A further object of the present invention is to provide a wide detection range even when a relatively weak light source is used.

According to one aspect of the present invention, there is provided an apparatus for determining an instantaneous spatial position of a spherical flying object comprising: irradiating means for generating a parallel light band, said flying object being caused to pass through said parallel light band; a screen on which said parallel light band is projected to form a linear image region, said flying object forming a silhouette within said image region upon passing through said parallel light band; and optical sensor means for detecting the position of said silhouette within said image region.

According to another aspect of the present invention, there is provided a method for determining an instantaneous spatial position of a spherical flying object comprising the steps of: projecting a parallel light band onto a screen to form a linear image region; causing said flying object to pass transversely through said parallel light band so that a silhouette of said flying object is formed within said image region on said screen; and causing an optical sensor means to detect the position of said silhouette within said image region.

Other objects, features and advantages of the present invention will be fully understood from the following detailed description given with reference to the accompanying drawings.

DETAILED DESCRIPTION OF THE PREFERRED EMBODIMENTS

Figure 1:
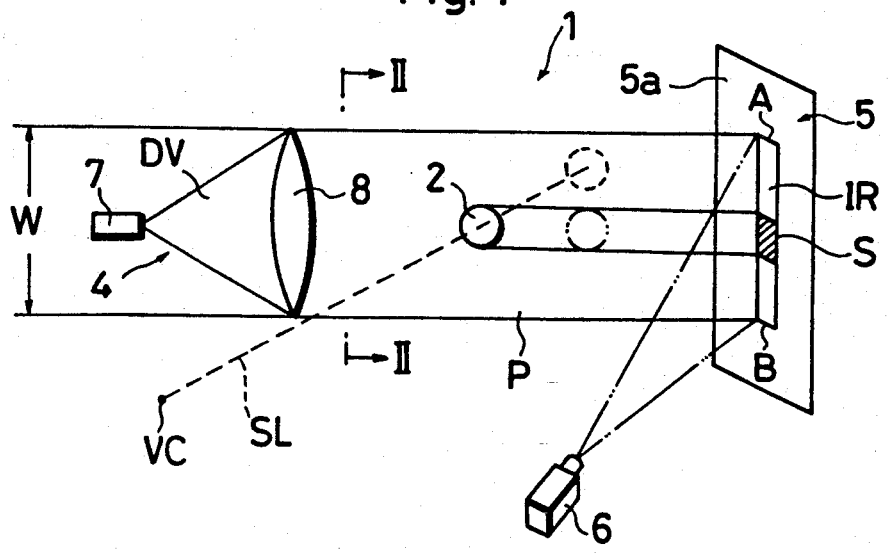
FIG. 1 is a schematic view showing a position determining apparatus embodying the present invention.

The accompanying drawings illustrate several embodiments of the present invention. Throughout the drawings, identical or substantially identical parts are represented by the same reference numerals and characters.

(EMBODIMENT 1)

Figure 2:
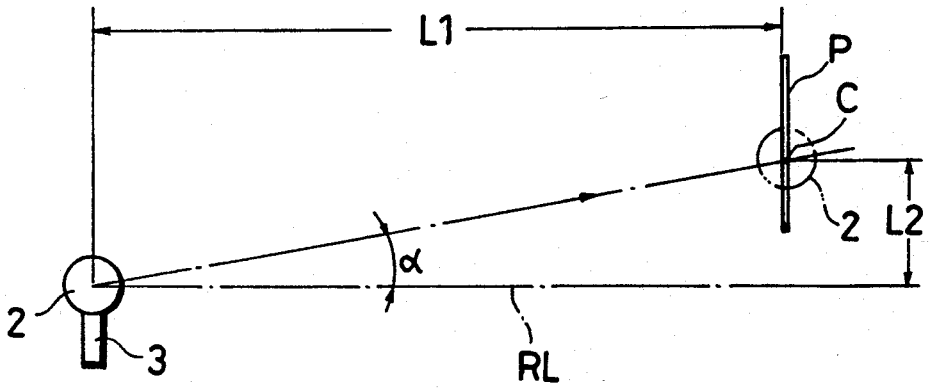
FIG. 2 is a view, as seen in the direction of arrows II—II in FIG. 1, showing the use of the same position determining apparatus.

FIGS. 1 and 2 show a position determining apparatus 1 according to a first embodiment of the present invention. The apparatus 1 is used to determine the spatial position of a spherical flying object 2 which may be a ball such as golf ball or tennis ball. According the illustrated embodiment, the spherical flying object 2 is a golf ball which has been hit from a tee 3 (FIG. 2).

The position determining apparatus 1 comprises an irradiator 4, a screen 5, and an optical sensor 6. According to the first embodiment, the irradiator 4 and the screen 5 are spaced horizontally.

The irradiator 4 includes a light source 7 and a collimator 8. The light source 7 emits diversing light DV, whereas the collimator 8 converts the diverging light into a parallel light band P.

Specifically, the light source 7 may be a Helium-Neon laser device having an output of 12 mW. The collimator 8 may be a convex lens having a diameter of about 140 mm and a focal distance of about 300 mm. To enable collimation, the laser device is positioned at the focal point of the convex lens, namely 300 mm away from the convex lens. In this case, the parallel light band P will have a width w of about 140 mm. Obviously, the width of the parallel light band P will vary when the diameter of the convex lens varies.

Alternatively, the light source 7 may comprise a combination of a point light source (not shown) and a cylindrical lens (not shown) for generating diverging light, whereas the collimator 8 may comprises a concave mirror (not shown) for collimating such diverging light.

In the illustrated first embodiment, the parallel light band P is contained in a vertical plane but directed horizontally to form a linear image region IR on the screen 5. The screen has a reflective surface 5*a* and is arranged vertically with a height of 300 mm for example. To insure that the optical sensor 6 conveniently receives the reflected light, the screen is slightly inclined relative to a vertical plane which is perpendicular to the parallel light band P.

In the first embodiment, the optical sensor 6 comprises a linear CCD camera having a line of 2048 picture elements with a scanning time of about 106 $\mu$s and a maximum output capacity of about 5 V. Alternatively, the optical sensor may comprise a two-dimensional CCD camera.

Before actually using the position determining apparatus 1, the apparatus may be tested for its accuracy in position determination. Such a test may be performed for example by using a height gauge (not shown) which has a measuring projection and a display.

Specifically, the measuring projection of the height gauge is made to penetrate transversely through the parallel light band P to form a silhouette in the linear image region IR. The optical sensor 6 (linear CCD camera) is caused to determine the center position of the silhouette by locating a picture element corresponding to the silhouette center. Then, the silhouette center position thus determined is compared with the indication or reading on the display of the height gauge itself. As a result, the two values have been found to show an accurately linear correlation substantially with a coefficient of unity. Thus, it has been confirmed that the position determining apparatus 1 provides reliable position determination.

In use, the golf ball 2 is hit from the tee 3 which is laterally spaced from the parallel light band P by a known distance L1 of 400 mm for example, as shown in FIG. 2. The hit ball 2 passes transversely through the parallel light band P, thereby forming a silhouette S within the linear image region IR on the screen 5. The optical sensor 6 (linear CCD camera) is caused to detect the position of the silhouette S to determine the height L2 of the ball 2 at the time of passing through the parallel light band P. The height L2 is defined as the distance of the flying ball 2 from a reference horizontal line RL passing through the non-hit ball.

Figure 3:
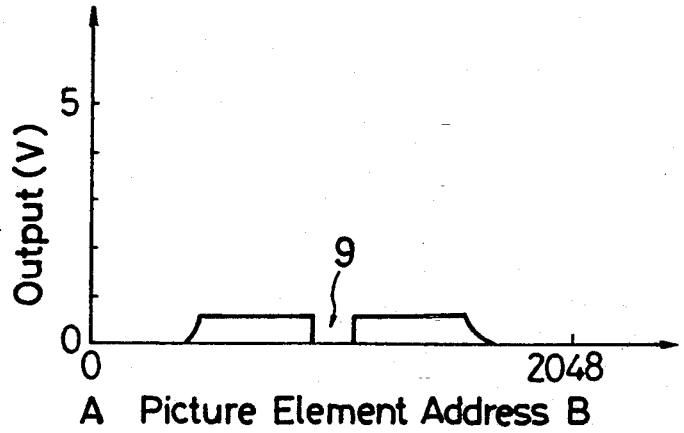
FIG. 3 is a graph showing the output voltage obtained by the same position determining apparatus.

As shown in FIG. 3, there is observed a sharp drop 9 in output voltage for those picture elements corresponding to the silhouette S. Thus, by locating a central one of the low voltage picture elements, it is possible to accurately determine the instantaneous height L2 of the ball 2 at the time of passing through the parallel light band P (FIG. 2).

In FIG. 3, two points A and B in the abscissa corresponds to the respective ends of the linear image region IR (FIG. 1), and it is appreciated that those picture elements positioned near these two points give no output because of weak light intensity Thus, only a limited length of the linear image region IR is effective for silhouette detection. In the first embodiment, actually, about $\frac{3}{4}$ of the linear image region IR is effective for silhouette detection, as shown in FIG. 3.

The height L2 thus determined may be used to calculate the initial vertical trajectory angle $\alpha$ of the hit ball 2 because the distance L1 of the tee 3 from the parallel light band P is already known. Specifically, the following equation is applicable.

$$\tan \alpha = L2/L1$$

therefore, $$\alpha = \tan^{-1}(L2/L1)$$

According to the method described above, the parallel light band P in no way obstructs the flying movement of the hit ball, as opposed to using a multiplicity of obtacle cords connected to electrical switches. Further, only the single optical sensor 6 is required for silhouette detection, as opposed to arranging a multiplicity of photoelectric switches. Moreover, the parallel light band P is always kept stationary to form the linear image region IR at a fixed position, so that such problems as experienced in relation to mechanical movement of a rotary polygon mirror or oscillating mirror will not occur.

More importantly, according to the inventive method, the position of the screen 5 is fixed, so that the positional relation between the screen and the optical sensor 6 is also fixed. Further, the ball 2 produces its silhouette S at the same position on the fixed screen as long as the ball passes through the parallel light band P at the same height (note the ball at the solid line position and the two-dot chain line position in FIG. 1). Thus, the optical sensor 6 always provides accurate height detection even if the ball flying path deviates horizontally.

By contrast, if the ball 2 is directly viewed by a video camera VC (also shown in FIG. 1 for clarity), the camera provides a ball image at the same height (position) as long as the ball is located on the same sight line SL (note the ball at the solid line position and the broken line position). Thus, the directly viewing camera VC provides inaccurate height detection when the ball flying path deviates horizontally, and the degree of inaccuracy becomes greater as the horizontal deviation is greater.

In this way, the inventive method is capable of eliminating or reducing all the problems which have been conventionally experienced.

(EMBODIMENT 2)

Figure 4:
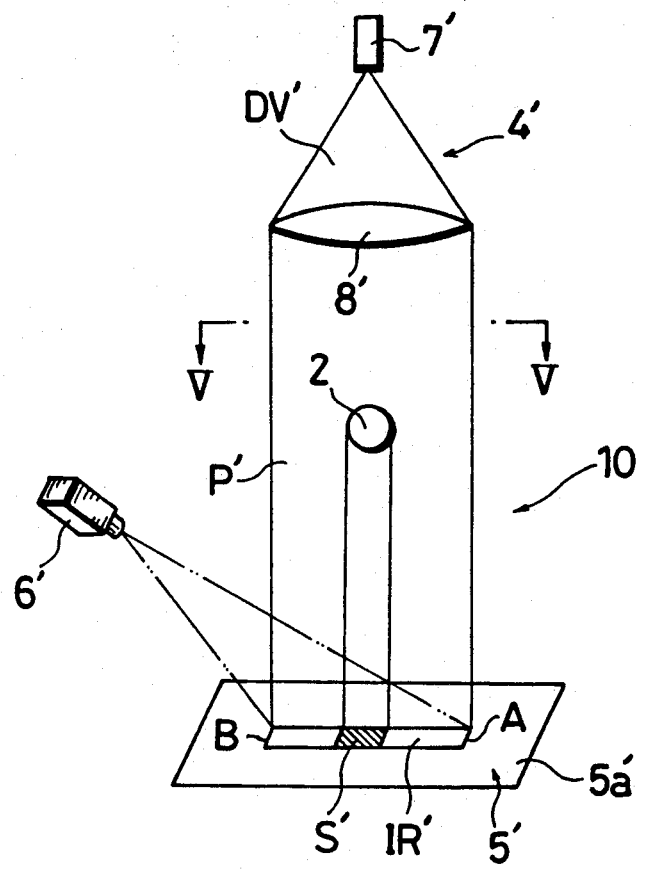
FIG. 4 is a schematic view showing another position determining apparatus embodying the present invention.
Figure 5:
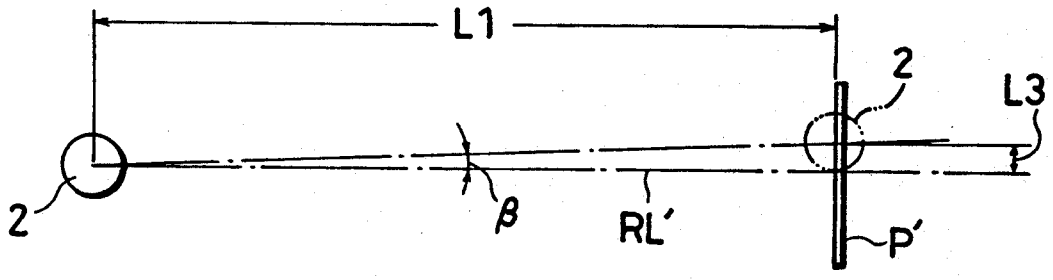
FIG. 5 is a view, as seen in the direction of arrows V—V in FIG. 4, showing the use of the apparatus of FIG. 4.

FIGS. 4 and 5 represent a position determining apparatus 10 according to a second embodiment of the present invention. This embodiment enables determining the initial horizontal trajectory angle, namely lateral deviation angle, of a hit ball 2.

Similarly to the first embodiment, the apparatus 10 of the second embodiment comprises an irradiator 4', a screen 5' and an optical sensor 6'. However, the irradiator 4', which includes a combination of a light source 7' and a collimator 8', generates a parallel light band P' projected vertically downward in a vertical plane. On the other hand, the screen 5' having a reflective surface 5a' is arranged horizontally to form a linear image region IR' in a horizontal plane. The optical sensor 6' is arranged above the screen in facing relation to the reflective surface 5a'.

In use, the ball 2 is hit to pass transversely through the parallel light band P' (FIG. 5), thereby forming a silhouette S' in the image region IR'. The optical sensor 6' is actuated to determine the horizontal displacement L3 (also FIG. 5) of the flying ball from a reference line RL' which passes through the non-hit ball. The horizontal displacement L3 thus determined may be further utilized to calculate the lateral deviation angle $\beta$ of the hit ball in the same manner as already described for the first embodiment.

Obviously, the positional relation between the irradiator 4' and the screen 5' may be reversed so that the screen is arranged above the irradiator. Further, the second embodiment may be combined with the first embodiment to determine both the initial trajectory angle $\alpha$ and lateral deviation angle $\beta$ (horizontal trajectory angle) of the hit ball.

(EMBODIMENT 3)

Figure 6:
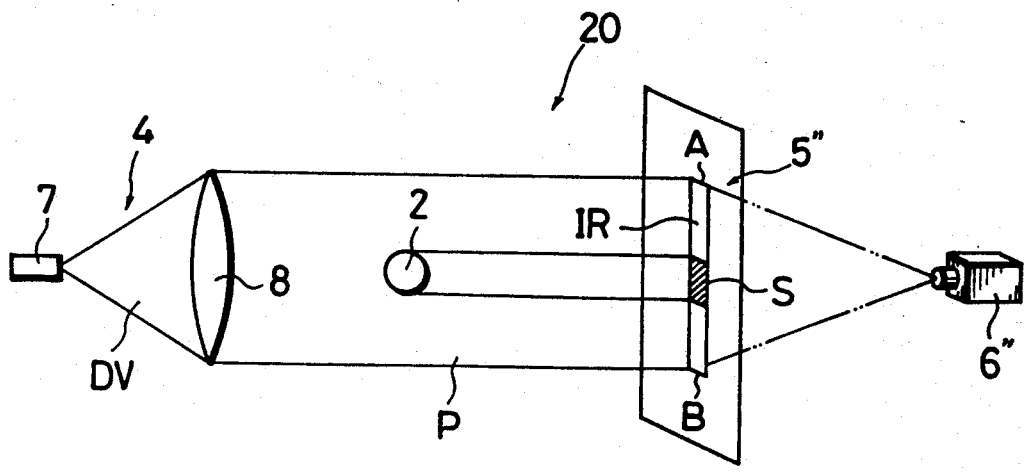
FIG. 6 is a schematic view showing a further position determining apparatus embodying the present invention.

FIG. 6 illustrates a position determining apparatus 20 according to a third embodiment of the present invention.

The apparatus 20 of the third embodiment is similar to that of the first embodiment but differes therefrom in that it comprises a semitransparent screen 5'' instead of a reflective screen, and an optical sensor 6'' arranged behind the screen. The screen may be made for example of semitransparent glass (specifically ground glass), semitransparent plastic, semitransparent cloth or semitransparent paper.

Figure 7:
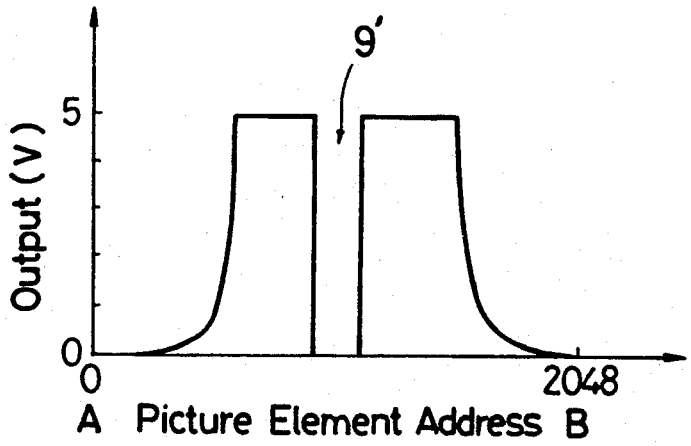
FIG. 7 is a graph showing the output voltage obtained by the apparatus of FIG. 6.

The optical sensor 6'' of the third embodiment may be a linear CCD camera having an output of about 5 V. FIG. 7 shows a graph showing the output of the optical sensor according to the third embodiment. As clearly shown, there is a sharp voltage drop 9' for those picture elements corresponding to the ball silhouette S. It is also seen in FIG. 7 that about ½ of the linear image region IR is effective for accurate position detection.

Obviously, the third embodiment may be modified to determine the lateral deviation angle of the hit ball. In this case, all the components of the apparatus 20 are disposed in a vertical arrangement.

(EMBODIMENT 4)

Figure 8:
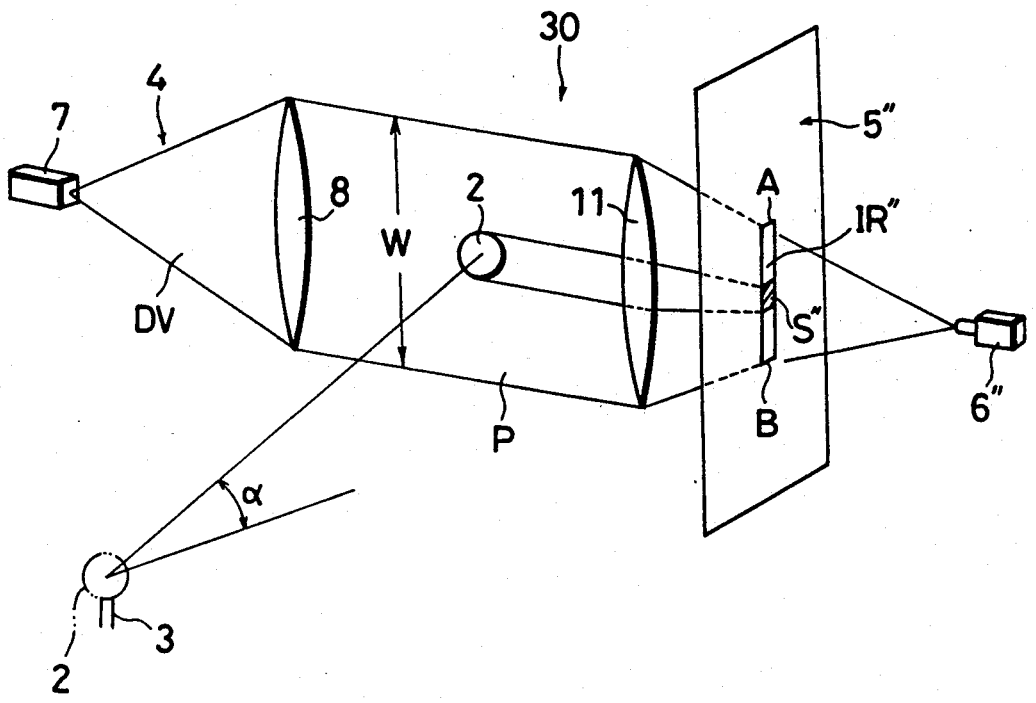
FIG. 8 is a schematic view showing still another position deteriming apparatus embodying the present invention.

FIG. 8 illustrates a position determining apparatus 30 according to a fourth embodiment of the present invention.

The apparatus 30 of the fourth embodiment is similar to that of the third embodiment but differs therefrom in that it additionally comprises a light condensing lens 11 arranged between the irradiator 4 and the semitransparent screen 5''. The condensing lens 11 converts the parallel light band P into converging light before forming a linear image region IR'' on the screen. Thus, the image including a ball silhouette S'' is intensified for more accurate detection.

Specifically, the light condensing lens 11 has a diameter of about 140 mm with a focal distance of about 300 . The semitranparent screen 5'' is located about half the focal distance of the condensing lens away therefrom, whereas the optical sensor 6'' is located near the focal point of the condensing lens. Thus, the length of the linear image region IR'' is about ½ of the width W of the parallel light band P.

Figure 9:
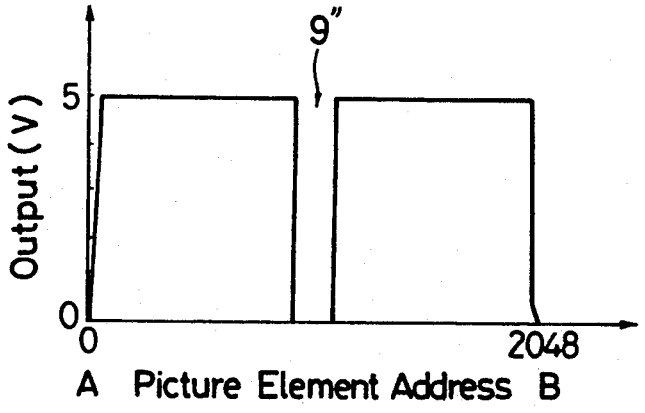
FIG. 9 is a graph showing the output voltage obtained by the apparatus of FIG. 8.

FIG. 9 shows the output of the optical sensor 6'' obtainable in the apparatus 30 of the fourth embodiment. As clearly appreciated, there is observed a sharp voltage drop 9'' for those picture elements corresponding the ball silhouette S'', whereas most of the remaining picture elements provides an output voltage of about 5 V. Because of the light intensification or concentration provided by the light condensing lens 11, even those picture elements nearly corresponding to the respective ends A and B of the linear image region IR'' provide a full output, consequently broadening the effective length of the linear image region for silhouette detection.

Obviously, the fourth embodiment may be modified to determine the lateral deviation angle of the hit ball. In this case, all the components of the apparatus 30 are disposed in a vertical arrangement.

The present invention being thus described, it is obvious that the same may be varied in many ways. For instance, the screen may be arranged in a dark box to prevent the adverse influences of the surrounding light. Further, the parallel light band need only be transversely penetrated by the flying object, so that the light band may be made to project in any direction. Such variations are not to be regarded as a departure from the spirit and scope of the present invention, and all such modifications as would be obvious to those skilled in the art are intended to be included within the scope of the following claims.

We claim:

1. An apparatus for determining an instantaneous spatial position of a spherical flying object comprising:

irradiating means for generating a parallel light band, a screen on which said parallel light band is projected to form a linear image region, said flying object being caused to pass transversely through said parallel light band at a position spaced from said screen to form a silhouette within said image region, and optical sensor means for detecting the position of said silhouette within said image region.

2. The apparatus of claim 1, wherein said parallel light band generated by said irradiating means is contained in a generally vertical plane but projected generally horizontally.

3. The apparatus of claim 1, wherein said parallel light band generated by said irradiating means is contained in a generally vertical plane and projected generally vertically.

4. The apparatus of claim 1, wherein said irradiating means comprises a light source for generating diverging light, and a collimator for converting said diverging light into said parallel light band.

5. The apparatus of claim 4, wherein said collimator is a convex lens, said light source being arranged at a focal point of said convex lens.

6. The apparatus of claim 1, wherein said optical sensor means comprises a CCD camera.

7. The apparatus of claim 1, wherein said screen has a reflective surface and is inclined relative to a plane perpendicular to the plane of said parallel light band, said optical sensor means being arranged to face said reflective surface.

8. The apparatus of claim 1, wherein said screen is made of a material selected from the group consisting of semitransparent glass, semitransparent plastic, semitransparent cloth and semitransparent paper, said optical sensor means being arranged behind said screen.

9. The apparatus of claim 1, further comprising a optical condensing means arranged between said irradiating means and said screen for condensing said parallel light band before projecting onto said screen.

10. The apparatus of claim 9, wherein said condensing means is a convex lens.

11. A method for determining an instantaneous spatial position of a spherical flying object comprising the steps of:

projecting a parallel light band onto a screen to form a linear image region;

causing said flying object to pass transversely through said parallel light band at a position spaced from said screen so that a silhouette of said flying object is formed within said image region on said screen; and causing an optical sensor means to detect the position of said silhouette within said image region.

12. The method of claim 11, wherein said flying object is a hit ball.

13. The method of claim 12, wherein said ball is a golf ball.

14. The method of claim 12, wherein said ball is a tennis ball.

15. The method of claim 12, wherein said ball is hit from a known position, the determined spatial position of the hit ball being used to determine the trajectory angle of the hit ball.

16. The method of claim 11, wherein said screen has a reflective surface, said optical sensor means being caused to detect said silhouette position from ahead of said screen.

17. The method of claim 11, wherein said screen is semitransparent, said optical sensor means being caused to detect said silhouette from behind said screen.

18. The method of claim 11, wherein said parallel light band is condensed before being projected onto said screen.

* * * * *